US005419660A

United States Patent [19]

Marquis

[11] Patent Number: 5,419,660

[45] Date of Patent: May 30, 1995

[54] BENDING AND FEEDING APPARATUS FOR INSTALLING A CABLE INTO A PREFORMED BORE

[75] Inventor: Guillaume Marquis, La Sarre, Canada

[73] Assignee: Metal Marquis Inc., La Sarre, Canada

[21] Appl. No.: 134,306

[22] Filed: Oct. 8, 1993

[51] Int. Cl.[6] ..... E21D 21/00

[52] U.S. Cl. ..... 405/259.1; 405/302.2; 405/303

[58] Field of Search ..... 405/259.1, 259.2, 259.4, 405/259.5, 259.6, 302.2, 303

[56] References Cited

U.S. PATENT DOCUMENTS

| | | | |
|---|---|---|---|
| 3,844,244 | 10/1974 | White | 114/221 |
| 3,913,338 | 10/1975 | Galis | 61/63 |
| 4,085,492 | 4/1978 | Stange | 29/431 |
| 4,147,458 | 4/1979 | Elders | 405/259 |
| 4,158,520 | 6/1979 | Prebensen | 405/260 |
| 4,229,124 | 10/1980 | Frey et al. | 405/303 |
| 4,445,668 | 5/1984 | Sauber | 254/287 |
| 4,453,845 | 6/1984 | Donan, Jr. | 405/259 |
| 4,508,251 | 4/1985 | Harada et al. | 226/25 |
| 4,514,111 | 4/1985 | Issakainen | 405/303 X |
| 4,589,803 | 5/1986 | Totten, III | 405/259 |
| 4,626,139 | 12/1986 | Blackwell | 405/259 |
| 4,710,065 | 12/1987 | Leppanen | 405/303 |
| 4,784,531 | 11/1988 | Calandra, Jr. | 405/261 |
| 4,832,289 | 5/1989 | Waggoner | 248/231.9 |
| 4,934,873 | 6/1990 | Calandra, Jr. | 405/288 |

FOREIGN PATENT DOCUMENTS

| | | |
|---|---|---|
| 841899 | 5/1970 | Canada . |
| 878834 | 8/1971 | Canada . |
| 1234672 | 4/1988 | Canada . |
| 89-7611 | 10/1989 | South Africa . |

OTHER PUBLICATIONS

Report 104—Cable Bolt Cassette System, BLM MINCON INC. Product Report, Jan. 1992.

THIESSEN TEAM LANGLEY, Serving the Mining Industry since 1954, "Team Talk", No. 2, vol. 3, May 1991.

*Primary Examiner*—David H. Corbin

*Attorney, Agent, or Firm*—Darby & Darby

[57] ABSTRACT

A bending and feeding apparatus and a method therefor are provided for installing a cable into a preformed bore. The apparatus comprises a main frame on which are mounted guiding means for guiding the cable along a path from an entry of the apparatus to an exit thereof, traction means mounted along the path for driving the cable forward, bending means mounted along the path for bending the cable, and shearing means mounted along the path for severing the cable. In operation, the free end of the cable is bent prior to its insertion into the bore. The bent free end is then driven into bore until it substantially reaches the bottom thereof. The cable is finally severed by the shearing means at the end of the operation.

13 Claims, 4 Drawing Sheets

BENDING AND FEEDING APPARATUS FOR INSTALLING A CABLE INTO A PREFORMED BORE

FIELD OF THE INVENTION

The present invention relates to a bending and feeding apparatus for installing a cable into a preformed bore.

BACKGROUND OF THE INVENTION

The installation of a cable into a preformed bore is particularly useful in the art of mine roof supports for reinforcing an unstable rock formation above a mine roof. Once the bore is drilled through the unstable rock formation and through a stable rock formation behind the unstable one, the cable is inserted into the bore with a retainer adapted for locking the free end of the cable at the bottom of the bore. Concrete is then injected into the bore and a retaining nut connected to the cable is installed at the outer edge of the bore for retaining adjacent rocks.

The retainer is generally an expansion shell gripping the stable rock formation surrounding the bottom of the bore. For some applications, more particularly for temporary roof supports, the retainer can be a bend in the free end of the cable. Temporary roof supports are often used for the safety of the workers who are drilling holes for the installation of blasting charges.

One of the problems with the installation of such cables is that they have to be cut somehow since they are usually commercially purchased in rolls where the cable has a great length. The long cable is generally cut with a circular saw blade or with a cutting torch for providing smaller cables of suitable length. It is generally very dangerous to cut the cable with saw blades or cutting torches in a mine draft because of the risks of explosions due to the presence of flammable gases which may be accidently lighted by the sparks generated when cutting the cable with a saw blade or by open flame of the cutting torch. The usual way of resolving that problem is to cut the cable outside the mine and provide precut cables of predetermined length on site. However, due to the unstable conditions of the rock strata above the mine roof, it is sometimes necessary to drill a bore hole to a greater depth than what is usually done, thereby creating the need of carrying precut cables of various lengths on site.

SUMMARY OF THE INVENTION

The object of the present invention is to provide a very compact and useful cable installing apparatus capable of bending, driving and severing a cable into a preformed bore, all these steps being done on site by the same apparatus without the generation of sparks or of an open flame.

More particularly, the object of the present invention is to provide a bending and feeding apparatus for installing a cable into a preformed bore, the apparatus comprising:

- a main frame;
- guiding means mounted on the main frame for guiding the cable along a path from an entry of the apparatus to an exit thereof;
- traction means mounted on the main frame along the path for driving the cable forward;

- bending means mounted on the main frame along the path for bending a free end of the cable; and
- shearing means mounted on the main frame along the path for severing the cable;
- whereby, in operation, the free end of the cable is bent prior to the insertion of the cable into the bore, the cable being inserted into the bore until the free end thereof substantially reaches the bottom of the bore, the cable being then severed by the shearing means.

According to a preferred embodiment, the bending means comprise:

- a lever operatively attached to the main frame by means of a first pivot, the lever being pivotable in a bending plane with respect to the first pivot between an initial position and a final position;
- actuating means for pivoting the lever, the actuating means having a first end operatively attached to an anchoring point and a second end operatively attached to the lever; and
- a cam having a first portion operatively attached to the lever by means of a second pivot and provided with a follower movable inside a substantially L-shaped slot made in the main frame and substantially extending from side to side of the apparatus, the cam is moved in the bending plane between a first position to a second position upon movement of the lever, the cam having a stop rigidly attached thereto for initially positioning the free end of the cable when the cam is in its first position, said follower applying a bending force on the free end of the cable during forward operation of the actuator.

According to another preferred embodiment, the bending means are closer to the exit of the apparatus than the shearing means.

According to a still preferred embodiment, the free end of the cable is bent into a substantially U-shaped bent.

According to a still preferred embodiment, the actuating means comprise a hydraulic actuator.

According to a still preferred embodiment, the guiding means comprise slides disposed around the path.

According to a still preferred embodiment, the guiding means further comprise entry rollers for guiding the cable at the entry of the apparatus.

According to a still preferred embodiment, the traction means comprise a plurality of driving rollers engaged with the cable.

It is another object of the present invention to provide a bending and feeding apparatus for installing a cable into a preformed bore, the apparatus comprising:

- a main frame;
- guiding means mounted on the main frame for guiding the cable along a path from an entry of the apparatus to an exit thereof;
- traction means mounted on the main frame along the path for driving the cable forward;
- bending means mounted on the main frame along the path for bending a free end of the cable in a substantially U-shaped bent, the bending means comprising:
  - a lever operatively attached to the main frame by means of a first pivot, the lever being pivotable in a bending plane with respect to the first pivot between an initial position and a final position;
  - a hydraulic actuator for pivoting the lever, the actuator having a first end operatively attached to an anchoring point and a second end operatively attached to the lever; and a cam having a first portion operatively attached to the lever by means of a second pivot and provided with a follower movable inside a substantially L-shaped slot made in the main frame and substantially extending from side to side of the apparatus, the cam is moved in the bending plane between a first position to a second position upon movement of the lever, the cam having a stop rigidly attached thereto for initially positioning the free end of the cable when the cam is in its first position, said follower applying a bending force on the free end of the cable during forward operation of the actuator;

shearing means mounted on the main frame along the path for severing the cable;

whereby, in operation, the free end of the cable is bent as the cam is moved from its first position to its second position prior to the insertion of the cable into the bore, the cable being inserted into bore until the free end thereof substantially reaches the bottom of the bore, the cable being then severed by the shearing means.

It is still another object of the present invention to provide a method for installing a cable into a preformed bore, the method comprising the steps of:

driving the cable a bending apparatus;

bending a free end of the cable in the bending apparatus;

aligning the bent free end of the cable in front of the bore;

driving the cable into the bore until the bent free end of the cable substantially reaches a bottom of the bore; and severing the cable;

whereby, in operation, a free end of the cable is bent prior to its insertion into the bore.

A non restrictive description of a preferred embodiment will now be given with reference to the appended drawings.

DESCRIPTION OF A PREFERRED EMBODIMENT

Figure 1:
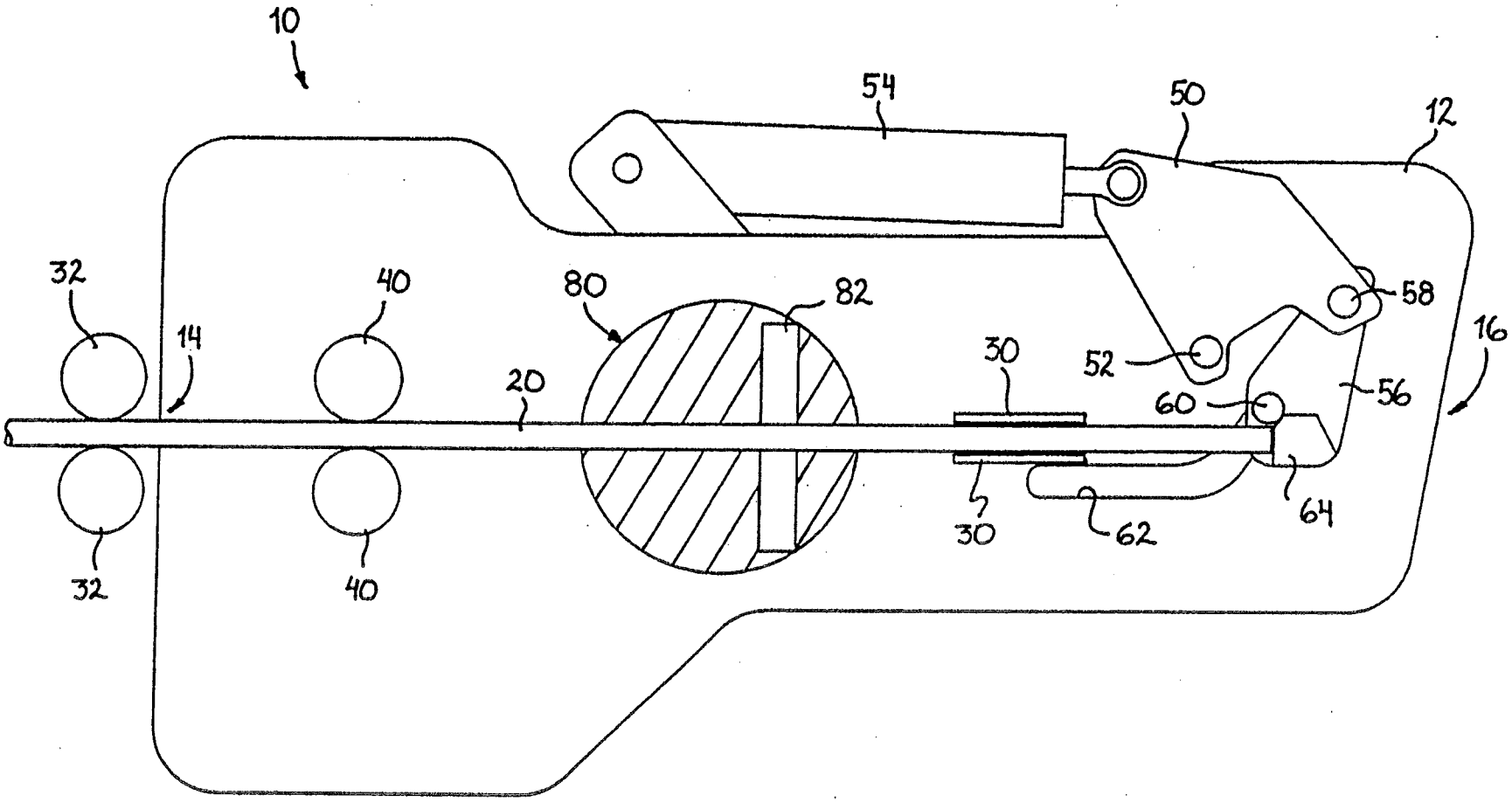
FIG. 1 is a side elevational view of the interior of the bending and feeding apparatus according to the present invention, where the apparatus is set at an initial position.

Referring to FIG. 1, the bending and feeding apparatus 10 comprises a main frame 12 on which are generally mounted the elements of the apparatus 10. The cable 20 is inserted in the apparatus 10 through the entry 14. The cable 20 is usually made of steel and brought on site in a roll.

The apparatus 10 is provided with guiding means for guiding the cable 20 along a path from the entry 14 of the apparatus 10 to the exit 16. These guiding means may comprise slides 30 disposed around the path, and entry rollers 32 for guiding the cable 20 at the entry 14.

The apparatus 10 is also provided with traction means mounted along the path for driving the cable 20 from the entry 14 toward the exit 16. The traction means are also provided for driving cable out through the exit 16. The traction means preferably comprise a plurality of driving rollers 40 directly engaged with the cable 20 and mechanically connected to a motor (not shown), preferably an hydraulic motor.

Bending means are further provided and are mounted along the path for bending the cable 20. These bending means preferably comprise a lever 50 operatively attached to the main frame 12 by means of a first pivot 52. The lever 50 is pivotable in a bending plane, with respect to the pivot 52, between an initial position, shown in FIG. 1, and a final position, shown in FIG. 2. The bending means also comprise actuating means for pivoting the lever, the actuating means having a first end attached to an anchoring point and a second end attached to the lever 50. The actuating means preferably comprise a hydraulic actuator 54. The anchoring point may be the main frame 12, such as shown in FIGS. 1 to 3, or a part of the boom 90 on which the apparatus 10 is mounted.

Figure 2:
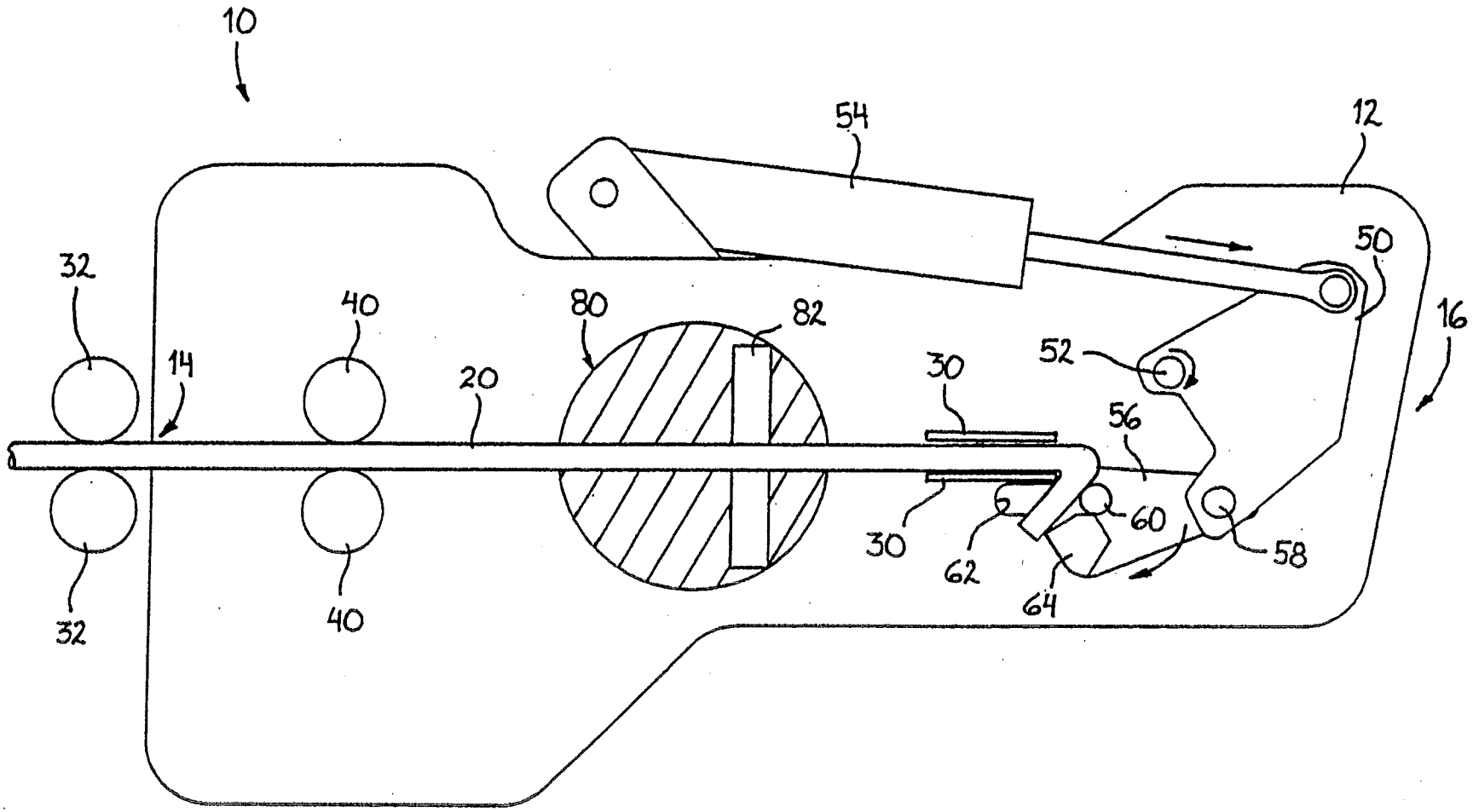
FIG. 2 is a side elevational view of the interior of the bending and feeding apparatus of FIG. 1, where the apparatus is bending the free end of the cable.
Figure 3:
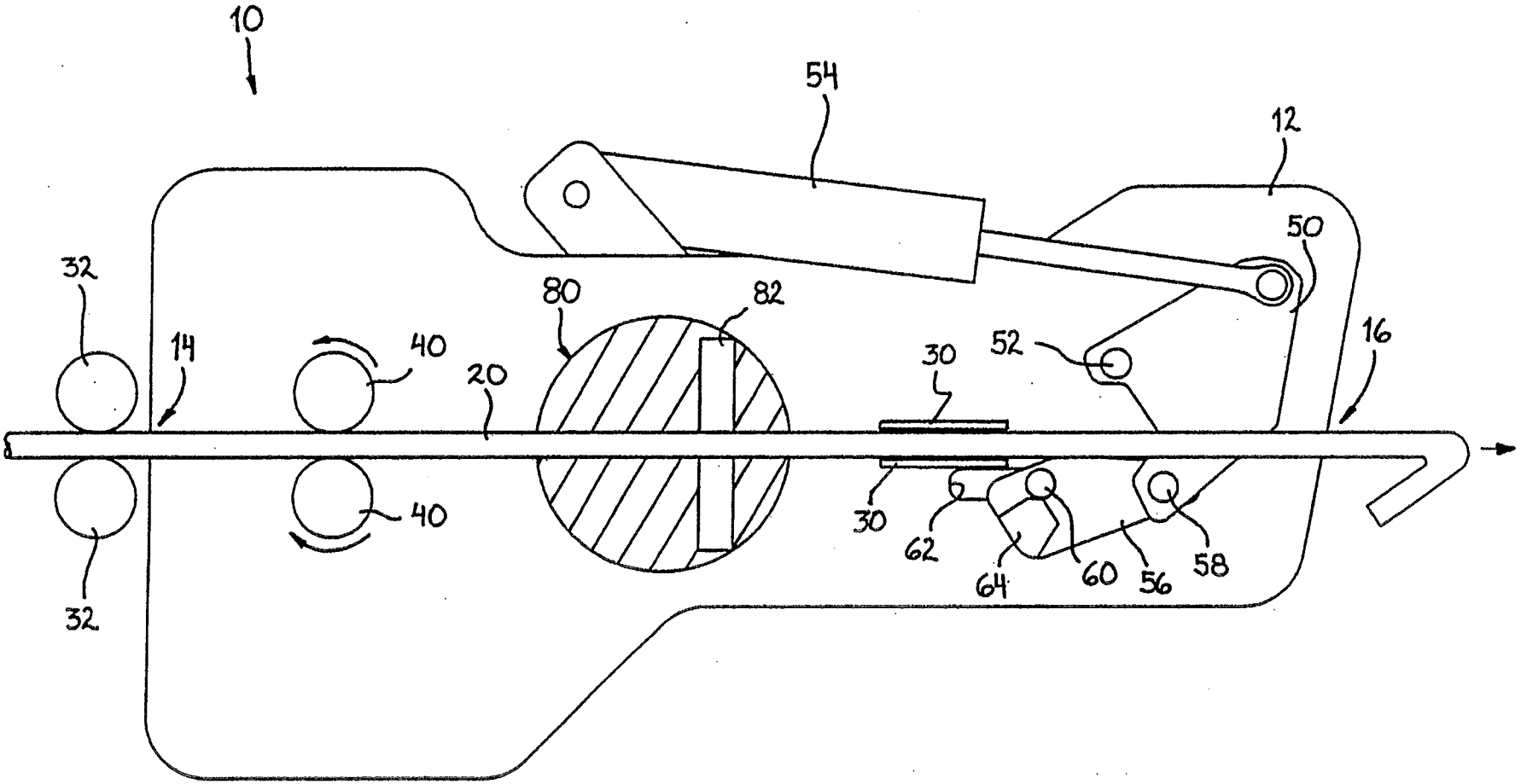
FIG. 3 is a side elevational view of the interior of the bending and feeding apparatus of FIG. 1, where the apparatus is driving out the cable through the exit thereof.

The bending means further comprise a cam 56 having a first portion operatively attached to the lever 50 by means of a second pivot 58 so that the cam 56 is moved in the bending plane between a first position, shown in FIG. 1, to a second position, shown in FIG. 2, upon initial operation of the actuator 54 moving the lever 50, the initial operation being defined as the extension of the actuator 54. To impose a specific mechanical movement to the cam 56, the cam 56 has a follower 60 movable inside a substantially L-shaped slot 62 made in the main frame 12 so that the cam 56 is translated as it turns on itself upon movement of the lever 50. The follower 60 extends from the left side to the right side of the apparatus 10.

The cam 56 is provided with a stop 64 rigidly attached thereto. The function of the stop 64 is to initially position the free end of the cable 20 at a location where the cable 20 can be bent by the bending means.

Referring to FIG. 2, the actuator 54 is operated for moving the cam 56 from its first position to its second position for bending the free end of the cable 20 into a substantially U-shaped bend. As the follower 60 moves inside the slot 62, it applies a bending force on the free end of the cable 20, which is bending around the slides 30.

Referring to FIG. 3, the bent free end of the cable 20, once completed, is driven out through the exit 16 by the driving rollers 40. At that point, the position of the stop 64 allows the cable 20 to be moved out.

Figure 4:
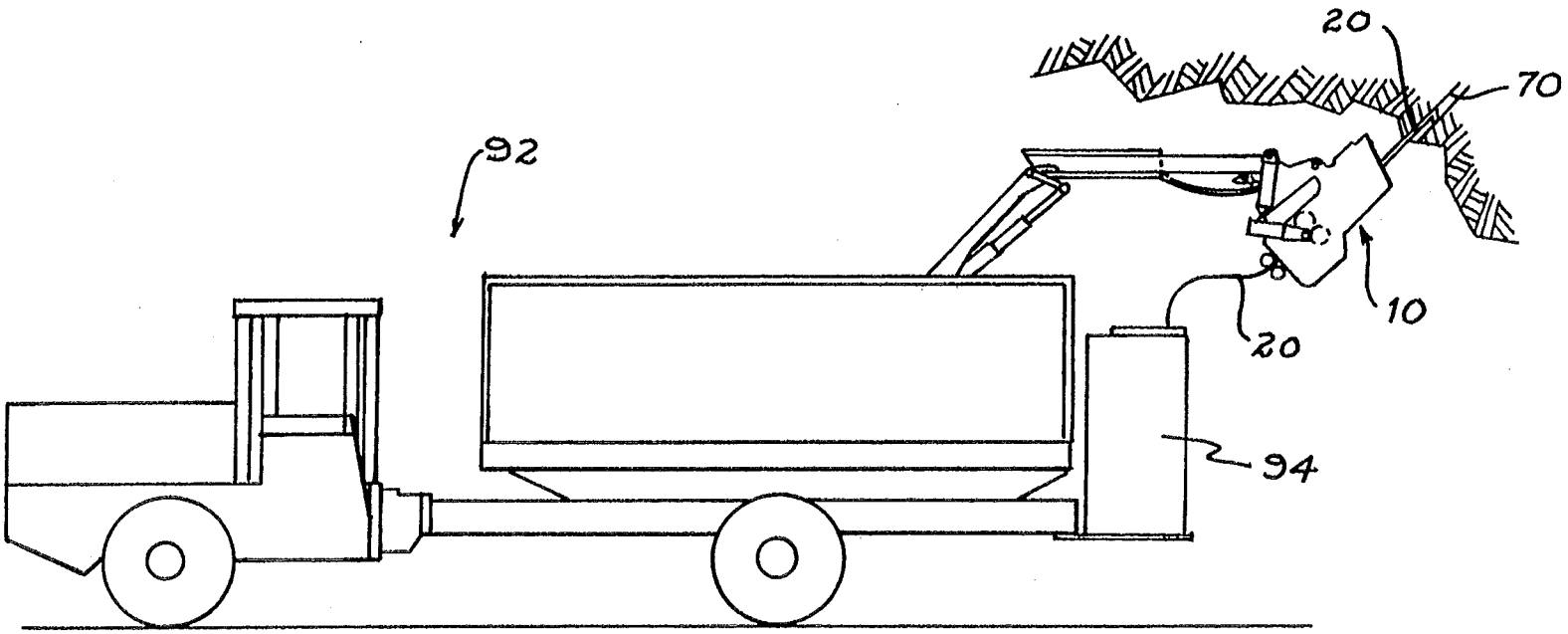
FIG. 4 is a side elevational view of a mining vehicle provided with a boom at the end of which is installed the bending and feeding apparatus according to the present invention.

Referring to FIG. 4, once the bent free end of the cable 20 is slightly out of the apparatus 10, it is aligned with the preformed bore 70 and the cable 20 is inserted therein until its bent free end substantially reaches the bottom of the bore 70. The U-shaped bend of the free end of the cable to allows the cable 20 to be retained in the bore 70. If a steel cable 20 is used, the bending of the free end generally separates the metallic strands of the utmost part thereof, thereby improving the hanging capabilities.

Referring to FIGS. 1 to 3, shearing means 80 are mounted in the main frame 12 along the path for severing the cable 20. The severing of the cable 20 is done when the insertion of the cable is completed, more particularly when the free end of the cable substantially reaches the bottom of the bore 70. The shearing means 80 may comprise one movable part 82, perpendicular to the cable 20, hydraulically pushed between two other parts (not shown). Preferably, the bending means are closer to the exit 16 than the shearing means 80.

Referring to FIG. 4, the apparatus 10 can be attached at the end of boom 90 provided on a mining vehicle 92. The cable rolls 94, hydraulic pump (not shown) and controls (not shown) can also be located directly on the vehicle 92.

The above-described apparatus 10 thus allows an improved method of installing a cable into a preformed bore. The method comprises the steps of driving the cable 20 from the entry 14 toward the exit 16, bending the free end of the cable 20, aligning the free end of the cable 20 in front of the bore 70, driving the cable 20 into the bore 70 until the free end of the cable substantially reaches a bottom of the bore 70, and severing the cable 20.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention. The above-described invention is also not limited to its use in the mining industry and is therefore suitable to a wide range of applications.

I claim:

1. A bending and feeding apparatus for installing a cable into a preformed bore, said apparatus comprising:

a main frame;

guiding means mounted on said main frame for guiding the cable along a path from an entry of said apparatus to an exit thereof;

traction means mounted on said main frame along said path for driving the cable forward toward said exit;

bending means mounted on said main frame along said path for bending a free end of the cable while the free end of the cable is within said bending and feeding apparatus; and shearing means mounted on said main frame along said path for severing the cable;

whereby, in operation, the free end of the cable is bent prior to the insertion of the cable into the bore, the cable being inserted into the bore until the bent free end of the cable substantially reaches the bottom of the bore, the cable being then severed by said shearing means.

2. An apparatus according to claim 1, wherein said bending means comprise:

a lever operatively attached to said main frame by means of a first pivot, said lever being pivotable in a bending plane with respect to said first pivot between an initial position and a final position;

actuating means for pivoting said lever, said actuating means having a first end operatively attached to an anchoring point and a second end operatively attached to said lever; and a cam having a first portion operatively attached to said lever by means of a second pivot and provided with a follower movable inside a substantially L-shaped slot made in said main frame and substantially extending from side to side of said apparatus, said cam being moved in the bending plane between a first position to a second position upon movement of said lever, said cam having a stop rigidly attached thereto for initially positioning the free end of the cable when said cam is in its first position, said follower applying a bending force on the free end of the cable during forward operation of said actuator;

whereby, in operation, the cable is bent as said cam is moved from its first position to its second position.

3. An apparatus according to claim 2, wherein said bending means are closer to the exit of said apparatus than said shearing means.

4. An apparatus according to claim 3, wherein the free end of the cable is bent into a substantially U-shaped bend.

5. An apparatus according to claim 2, wherein said actuating means comprise a hydraulic actuator.

6. An apparatus according to claim 1, wherein said guiding means comprise slides disposed around said path.

7. An apparatus according to claim 6, wherein said guiding means further comprise entry rollers for guiding said cable at the entry of said apparatus.

8. An apparatus according to claim 1, wherein said traction means comprise a plurality of driving rollers engaged with the cable.

9. An apparatus according to claim 1, wherein said bending means comprise a cam provided with a follower movable inside a substantially L-shaped slot made in said main frame, said cam being moved in a bending plane between a first position and a second position, said cam having a stop rigidly attached thereto for initially positioning the free end of the cable when said cam is in its first position, said follower applying a bending force on the free end of the cable during forward operation of an actuating means, whereby, in operation, the cable is bent as said cam is moved from its first position to its second position.

10. An apparatus according to claim 1, wherein said bending means bends the free end of the cable back on itself into a substantially U-shaped bend.

11. A bending and feeding apparatus for installing a cable into a preformed bore, said apparatus comprising:

a main frame;

guiding means mounted on said main frame for guiding the cable along a path from an entry of said apparatus to an exit thereof;

traction means mounted on said main frame along said path for driving the cable forward;

bending means mounted on said main frame along said path for bending a free end of the cable in a substantially U-shaped bent, said bending means comprising:

a lever operatively attached to said main frame by means of a first pivot, said lever being pivotable in a bending plane with respect to said first pivot between an initial position and a final position;

a hydraulic actuator for pivoting said lever, said actuator having a first end operatively attached to an anchoring point and a second end operatively attached to said lever; and a cam having a first portion operatively attached to said lever by means of a second pivot and provided with a follower movable inside a substantially L-shaped slot made in said main frame and substantially extending from side to side of said apparatus, said cam being moved in the bending plane between a first position to a second position upon movement of said lever, said cam having a stop rigidly attached thereto for initially positioning the free end of the cable when said cam is in its first position, said follower applying a bending force on the free end of the cable during forward operation of said actuator;

shearing means mounted on said main frame along said path for severing the cable;

whereby, in operation, the free end of the cable is bent as said cam is moved from its first position to its second position prior to the insertion of the cable into the bore, the cable being inserted into the bore until the free end thereof substantially reaches the bottom of the bore, the cable being then severed by said shearing means.

12. A method for installing a cable into a preformed bore, said method comprising the steps of:

driving the cable toward a bending means;

bending a free end of the cable within the bending means;

aligning the bent free end of the cable with the bore;

driving the cable into the bore until the bent free end of the cable substantially reaches a bottom of the bore; and severing the cable;

whereby, in operation, a free end of the cable is bent prior to its insertion into the bore.

13. A method according to claim 12, wherein said step of bending a free end of the cable further comprises the step of bending a free end of the cable back on itself into a substantially U-shaped bend.

* * * * *